US009110444B2

(12) United States Patent
Knuchel et al.

(10) Patent No.: US 9,110,444 B2
(45) Date of Patent: Aug. 18, 2015

(54) DEVICE FOR ORIENTATING A SCREWDOWN ELEMENT FOR A TIMEPIECE

(75) Inventors: Daniel Knuchel, Biel (CH); Sebastien Briswalter, Pfetterhouse (FR)

(73) Assignee: Omega SA, Biel/Bienne (CH)

( * ) Notice: Subject to any disclaimer, the term of this patent is extended or adjusted under 35 U.S.C. 154(b) by 99 days.

(21) Appl. No.: 14/115,503

(22) PCT Filed: Jun. 5, 2012

(86) PCT No.: PCT/EP2012/060602

§ 371 (c)(1),
(2), (4) Date: Nov. 4, 2013

(87) PCT Pub. No.: WO2012/168243

PCT Pub. Date: Dec. 13, 2012

(65) Prior Publication Data

US 2014/0071797 A1 Mar. 13, 2014

(30) Foreign Application Priority Data

Jun. 8, 2011 (EP) ..... 11169052

(51) Int. Cl.
*G04B 3/04* (2006.01)
*G04B 37/10* (2006.01)

(52) U.S. Cl.
CPC ..... *G04B 3/043* (2013.01); *G04B 37/103* (2013.01)

(58) Field of Classification Search
CPC ..... G04B 3/04; G04B 3/043
See application file for complete search history.

(56) References Cited

U.S. PATENT DOCUMENTS

| | | | | |
|---|---|---|---|---|
| 5,699,327 | A * | 12/1997 | Boissenin et al. | 368/308 |
| 5,923,622 | A | 7/1999 | Chung | |
| 6,974,248 | B2 * | 12/2005 | Damasko | 368/308 |
| 8,366,314 | B2 * | 2/2013 | Marti | 368/308 |
| 2004/0130971 | A1 | 7/2004 | Ecoffet et al. | |
| 2007/0025190 | A1 * | 2/2007 | Cretin | 368/319 |

FOREIGN PATENT DOCUMENTS

| | | |
|---|---|---|
| EP | 1 124 167 | 8/2001 |
| EP | 1 411 401 | 4/2004 |
| EP | 1 701 225 | 9/2006 |
| EP | 2 182 417 | 5/2010 |
| EP | 2 385 432 | 11/2011 |

OTHER PUBLICATIONS

International Search Report Issued Sep. 26, 2012 in PCT/EP12/60602 Filed Jun. 5, 2012.

* cited by examiner

*Primary Examiner* — Amy Cohen Johnson
*Assistant Examiner* — Jason Collins
(74) *Attorney, Agent, or Firm* — Oblon, McClelland, Maier & Neustadt, L.L.P.

(57) ABSTRACT

An orientable screwdown crown includes a cover and a device for adjusting the angular orientation of the cover in relation to a watch centerpart. The device for adjusting the angular orientation includes a coupling member and an indexing unit between the cover and the coupling member as well as a restoring unit, which endeavor to rotationally fix the cover and the coupling member. The indexing unit includes a first tooth arrangement arranged on the coupling member.

10 Claims, 2 Drawing Sheets

DEVICE FOR ORIENTATING A SCREWDOWN ELEMENT FOR A TIMEPIECE

CROSS-REFERENCE TO RELATED APPLICATIONS

This is a National Phase Application in the United States of International Patent Application PCT/EP 2012/060602 filed Jun. 5, 2012, which claims priority on European Patent Application No. 11169052.5 of Jun. 8, 2011

BACKGROUND OF THE INVENTION

1. Field of the Invention

The present invention relates to a device for adjusting the orientation of screwdown elements for timepieces, and more specifically for crowns having a design or a logo on their end face and in which said design can be oriented as desired.

2. Discussion of the Background

Screwdown crowns are currently used for fitting into watches for the purpose of improving their seal at their winder or control stem. This type of crown has the special feature of being able to assume an unscrewed position, in which the watch can be wound up, the time set etc., and a screwdown position in which the crown is screwed down and locked on a pressed down or screwdown tube in the centrepart of the watch case in order to compress a gasket, thus improving the seal of the watch. The screwdown position is therefore that corresponding to the normal position when the watch is worn and that is more or less always subject to wear of the gasket.

The fabrication and assembly of these screwdown crowns on watch cases are well known. However, the methods of assembly of these crowns are poorly suited to screwdown crowns that bear an inscription or design on their end face, e.g. a logo, a manufacturers' mark or similar mark. In fact, the known methods of assembly do not generally allow the crown to be brought into a specific orientation in relation to the case after they have been screwed down, and this spoils the aesthetics of the case when an inscription is affixed to the end face of the crown. This situation is, of course, unacceptable when these crowns are fitted to luxury and high-quality products.

One solution that allows a crown to be adjusted in a specific position or orientation after being screwed down onto the tube has already been proposed in document EP 1 124 167 A1. According to this document a ring made of shape memory alloy is placed either between the centrepart and the tube or between the crown and the tube. By using the deformation of the ring, in particular reducing its diameter by subjecting the watch to specific temperatures, a temporary clearance can be created between the centrepart and the tube and between the crown and the tube respectively, and this clearance allows angular adjustment of the crown in its screwdown position. A disadvantage of this solution lies in the fact that shape memory alloys are not currently available in the form of bars of small dimensions, and therefore it is difficult and expensive to machine the rings in question to attain the small dimensions required for the applications in question. Moreover, this process is only intended for the initial assembly of the crown by the manufacturer of the watch and not for subsequent adjustment operations for orientation of the crown, which would pose the risk of damaging other parts of the watch that are sensitive to temperature variations.

The document EP 1701225 describes an orientable screwdown crown comprising a head integral to a winder stem and a cover, on which an inscription appears, wherein the head and the cover are rotationally fixed by means of truncated cone-shaped surfaces that are held in contact with one another by means of an elastic element. The angular position of the cover is adjusted by pulling this axially out in relation to the centrepart along the longitudinal axis of the crown. A major disadvantage of this solution is that the rotationally fixed arrangement of the cover in relation to the head is only assured by the frictional forces between the truncated cone-shaped surfaces, and this does not prove to be sufficiently reliable over the service life of a watch and in particular when the compression forces exerted by the elastic element progressively diminish. Moreover, another disadvantage is that it cannot be guaranteed that the same angular position can be obtained in a precise manner, since the angular position can only be determined by successive approximations.

The document EP 1411401 describes a particular crown, which on its upper outside face comprises a substrate that is orientable in relation to a head formed by a central body and a lateral skirt, wherein the substrate is provided with an inscription, and can be rotationally separated from the head of the crown when a pressure is applied against braking means. The disadvantage with this solution is that it is not very robust with respect to shocks, and such shocks can also apply a pressure force onto the substrate and thus reorientate in relation to the body of the crown at an inappropriate time. Moreover, when gripping the crown it is necessary to take numerous precautions to ensure that no pressure is introduced in the direction of the crown if an untimely rotation of the substrate is to be avoided, and this makes usage somewhat inconvenient. Moreover, although indexing means can be provided to position the substrate in predefined angular positions, the inability to grip the substrate correctly makes the adjustment operation very delicate and not necessarily very precise.

SUMMARY OF THE INVENTION

The aim of the present invention is to remedy the disadvantages of the aforementioned prior art by providing a device for the orientation of a screwdown element such as a traditional crown that is simple and economical to construct, comprising a design such as a logo or a trademark and in which the position of the logo or trademark affixed to the end face of said element can be easily adjusted in a determined position or orientation.

Another aim of the present invention is to provide an orientation device that is more reliable than those proposed hitherto.

On this basis, the invention relates to an orientable screwdown element comprising a cover and a device for adjusting the angular orientation of the cover in relation to a watch centrepart, characterised in that the device for adjusting the angular orientation comprises a coupling member and indexing means between the cover and the coupling member as well as restoring means. The cover and the coupling member are axially movable relative to one another between a first position, in which the cover is rotationally fixed in relation to the coupling member, and a second position, in which the cover is free to turn around the rotational axis of the orientable screwdown element, wherein the restoring means endeavour to rotationally fix the cover and the coupling member in the first position.

Because of these features, the orientation of the design borne by the cover can be easily adjusted in a determined angular position that is reproducible in the long term in relation to the centrepart, at the same time preventing any accidental handling error on the part of the user. The orientation of the restoring means as well as the direction of the forces exerted by the restoring means make it possible to determine the amount of force required to perform the adjustment of the orientable screwdown element. Moreover, the arrangement of the indexing means in relation to the coupling member and the direction of the forces exerted by the restoring means enable it to be determined whether it is required that this adjustment may only be performed when the orientable screwdown element is removed from the watch case, i.e. by the manufacturer during assembly or during servicing, for example, or also by the user of the watch him/herself without the aid of a tool.

Furthermore, this new construction has the advantage of being invisible to the user from outside the screwdown element, since the proposed adjusting device is covered and concealed by the cover. The aesthetic appearance of the watch is thus unaffected by this.

Another advantage of the present invention is the ability to adapt to any type of cover because of the presence of the coupling element, such that the device can be modularly adapted to potentially any crown-type element that has a central opening to accommodate a tube there that is screwed to the centrepart of the watch.

BRIEF DESCRIPTION OF THE DRAWINGS

Other features and advantages of the present invention will become evident in the following description of a preferred embodiment presented by way of non-restrictive example with reference to the attached drawings.

DETAILED DESCRIPTION OF THE PREFERRED EMBODIMENTS

Figure 1:
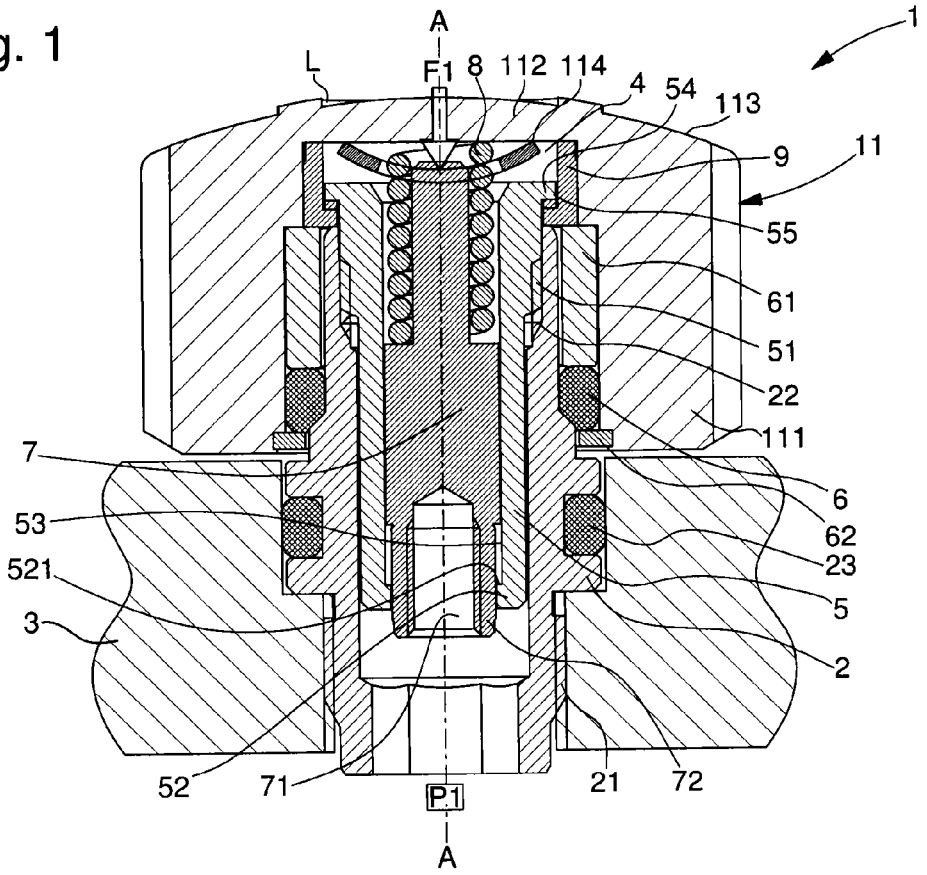
FIG. 1 shows a cut-away view of a screwdown element consisting of an orientable crown provided with the device for adjusting the orientation according to a preferred embodiment of the invention in a position screwed to the centrepart.

The preferred embodiment illustrated in FIG. 1 shows a sagittal cut-away view of a screwdown element given the general reference 1, which consists here of a crown, taken along its rotational axis A-A, to reveal the mechanism for adjusting the orientation in accordance with a preferred embodiment of the invention. The crown is represented therein in position screwed onto a threaded tube 2 that is screwed into a centrepart 3 of a watch case by means of the first thread 21, while an internal thread 22 cooperates with the thread 51 of a tubular coupling member 5. According to an alternative embodiment, the internal thread 22 of the tube could, however, consist of a second thread and the thread 51 of the coupling member 5 could accordingly consist of an internal thread, as on a classic crown head. A gasket 23 is also arranged between the tube and the centrepart 3.

The coupling member 5 is an intermediate element between the cover 11 of the crown, which is used by the user to grip the latter, and the centrepart 3. The coupling member 5 is intended, on the one hand, to determine several modes of usage of the crown: in a locking position in relation to the centrepart 3—here by means of the threaded tube 2—the crown assures the seal of the system but cannot be manipulated, whereas in an adjustment position it is axially free to set an adjustment mode and rotationally free to perform the desired adjustment when the latter is classically mechanically connected to a winder stem and a pull-out piece, the axial position of which defines the adjustment mode. On the other hand, the coupling member 5 similarly determines an adjustment mode and a locked mode for orientation of the crown as a function of the relative axial position of the coupling member 5 and the cover 11. The locked mode for the angular orientation, given the reference P1, is illustrated in FIG. 1, whereas the adjustment mode of the angular orientation, given the reference P2, is illustrated in FIG. 2. According to the illustrated preferred embodiment, the coupling member 5 is configured as a motion work inserted into the interior of the threaded tube 2.

In the illustration of FIG. 1 the central part of the crown is connected to a winder stem (not shown) of the timepiece movement by means of a threaded blind hole 71 arranged in the lower portion 72 of a piston 7 accommodated in an axial cavity 53 inside the coupling member 5. The piston 7 slides against a spring 8 in abutment against an inside surface 114 of the covering cap 112 of the cover 11, and in particular allows the cover 11 to come out of the centrepart when the crown is unscrewed from the tube to perform the adjustment. Since the piston 7 is intended to be connected to the winder stem, its axial position in relation to the centrepart is indexed according to typically 3 discrete values: a first value corresponding to the winding up of the barrel, for example, another corresponding to the adjustment of the time and a third corresponding to the adjustment of the day of the month. A gasket 6 such as an O ring, for example, is interposed between the threaded tube 2 and the axial skirt 111 of the cover 11 in order to assure the seal of the watch. In the position screwed to the crown, said gasket is held axially between rings 61, 62 and compressed onto a portion of the tube 2, as shown at a in FIG. 1. Alternatively, the holding rings 61, 62 could be replaced by an annular recess arranged in the axial skirt 111 of the cover 11, which extends along the tube 2.

According to the invention the cover 11 is joined to the coupling member 5 so that they are usually rotationally and axially fixed to one another. This arrangement is configured to be detachable or reversible.

Figure 3:
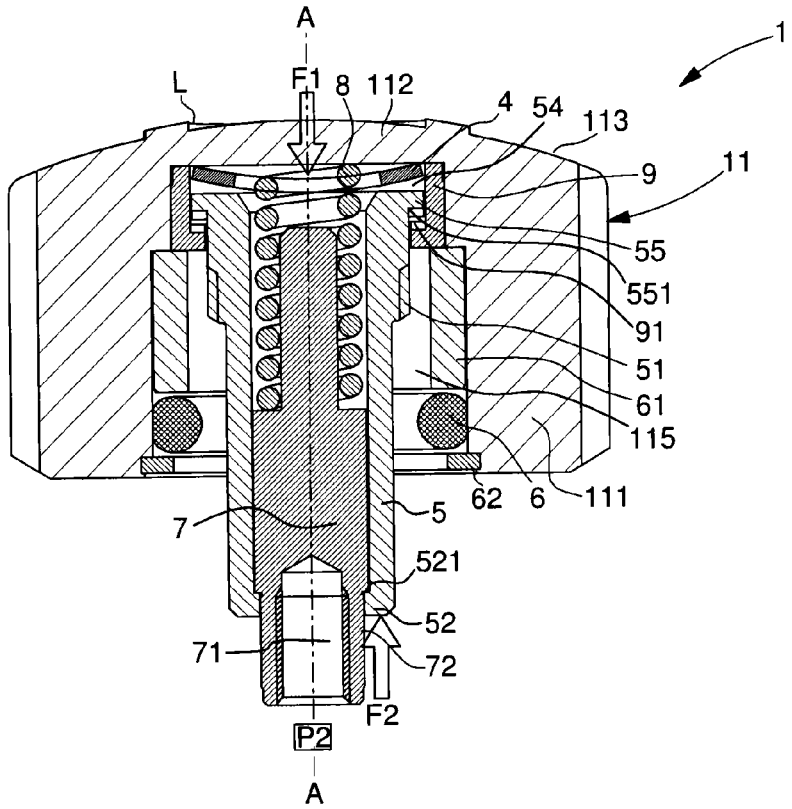
FIG. 3 is a cut-away view similar to FIG. 2, wherein the crown is shown in a position in which its cover is separated from the head for the purpose of angular orientation into a determined position of the design borne by the cover, shown in position separated from the centrepart.

The cover 11 is formed by a covering cap 112 and an axial skirt 111, which together define a central opening 115 inside the crown forming the screwdown element 1—only referenced in FIG. 3 for reasons of clarity—and in which firstly the end of the threaded tube 2 is arranged integral to the centrepart 1, but also the coupling member 5. The covering cap 112 comprises an upper surface 113, on which a design such as a logo or a trademark L is affixed that is visible from outside the crown—the logo Omega of the Applicant is evident, for example, in the left section of the figure.

The crown additionally comprises restoring means 4, which endeavour to render the cover 11 and the coupling member 5 rotationally fixed by applying a pressure force F1 between indexing means 551 of the coupling member 5 and the cover 11. According to the illustrated preferred embodiment the restoring means 4 are interposed between the substantially plane inside surface 114 of the covering cap 112 and the likewise substantially plane upper surface 54 of the coupling member 5, and hold a tooth arrangement 551 arranged on the lower face of a collar 55 abutting against the tooth arrangement 91 of an intermediate element 9 integral to the cover 11 and fixed, for example, by welding, crimping or any other appropriate method. According to the illustrated embodiment the force F1 acts in the direction of the rotational axis A-A towards the interior of the centrepart 3 and the form and plastic properties of the material of the restoring means 4 are chosen so that the intensity of the exerted force F1 is substantially greater than the force required to change the axial position of a classic pull-out piece, which is generally less than ten Newton. According to a preferred embodiment the restoring means 4 are arranged so that the intensity of the force F1 is preferably equal to 14 Newton, which corresponds to the abovementioned criteria without, however, requiring the application of a force of excessive intensity to separate the cover 11 from the coupling member 5 and to perform the operation of adjusting the orientation of the crown.

The coupling member 5 housing the piston in its axial cavity 53 additionally has a lower end 52, on which inside abutment surfaces 521 are arranged to limit the course of the piston in relation to the coupling element 5 when this is unscrewed from the tube 2.

Figure 2A:
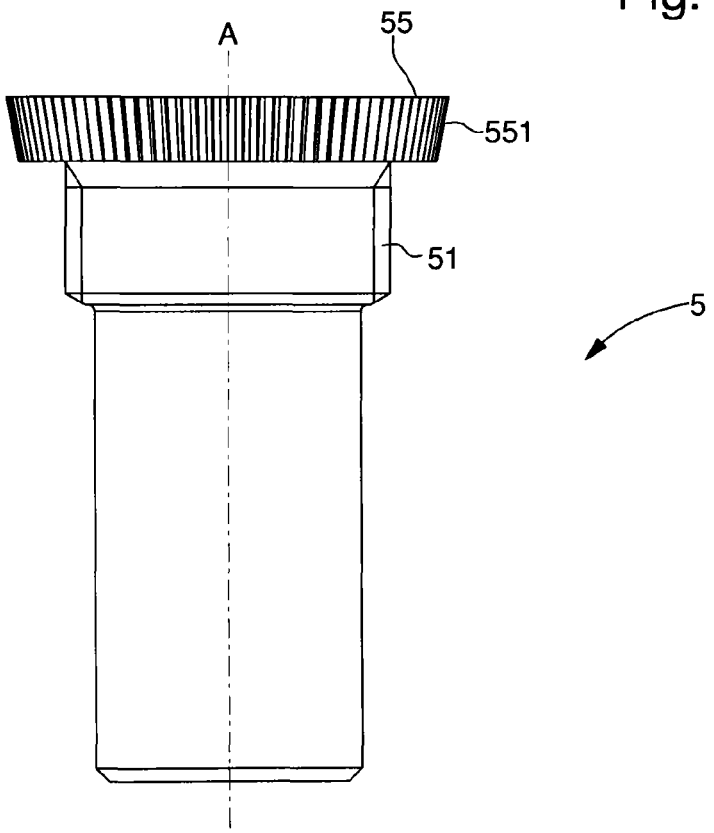
FIGS. 2A and 2B show two preferred embodiments of a coupling member according to the invention.
Figure 2B:
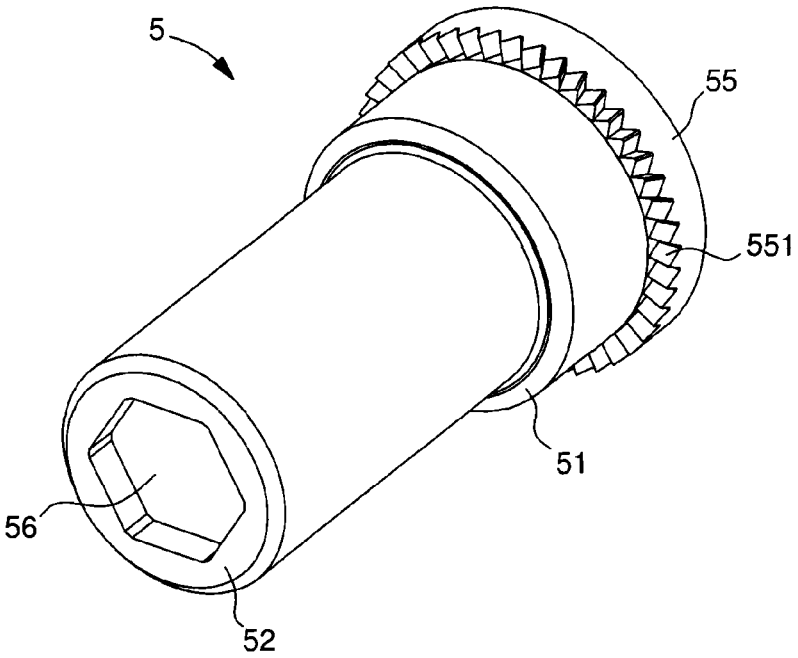

FIGS. 2A and 2B show two preferred embodiments of a coupling member 2 according to the invention, each comprising a collar 55, on which the tooth arrangements 551 used as indexing means are arranged, as well as a thread 51 intended to cooperate with an integral piece of the centrepart such as the threaded tube 2 described in FIG. 1. According to the embodiment of FIG. 2A the tooth arrangement is arranged obliquely in relation to rotational axis A-A, which corresponds to that of the crown 1, whereas in FIG. 2B the tooth arrangement is arranged on a lower face of the collar in a perpendicular plane to this rotational axis A-A. The significance of an oblique tooth arrangement in relation to a perpendicular plane to the rotational axis A-A is that when the forces exerted by the restoring means 4 are in the direction of this rotational axis A-A, a more significant displacement of the coupling member 5 is required to disengage the tooth arrangement 551, since the latter extends over a more significant axial distance. The force to be exerted against the restoring means 4 will thus be more significant and the security of engagement against possible handling errors will be better. Consequently, if the aim is to facilitate disengagement of the tooth arrangement 551, the variant of FIG. 2B could be preferred, for example, if no handling error is possible for the user, as is the case with the variant described in FIGS. 1 and 3, as explained below.

According to the described preferred embodiment the indexing means consist of two tooth arrangements pressed against one another working together, the first tooth arrangement 551 being arranged on the coupling member 5 and the second tooth arrangement 91 arranged on an intermediate element 9 integral with the cover 11. However, it could be conceivable that the second tooth arrangement 91 is arranged directly on an inside wall of the cover 11 and/or one of the tooth arrangements 551 or 91 is replaced by an elastic indexing element. The latter possibility certainly reduces the number of pieces to be used for the proposed device for adjusting the angular orientation of the crown, but nevertheless provides less security of engagement and introduces frictional forces for the adjustment (e.g. in the case of an oblique tooth arrangement, on the coupling member 5 in accordance with FIG. 2A and the restoring means 4 in the form of a plastically deformable concave element having a slightly smaller width than the maximum diameter of the collar 55 of the coupling member and provided with one or more notches on its periphery; in this case a downward pressure would allow disengagement of the notches, but friction would be present at the contact surfaces between the coupling member 5 and the concave elastic element).

In the preferred embodiment illustrated in FIG. 2B a hexagonal opening 56 is evident in the lower end of the coupling member 52. This opening is intended to cooperate with the lower end of the piston 72, which likewise has a hexagonal shape of corresponding size in this case. Although it is still necessary to provide an orifice and abutments for the piston 7 on the coupling member 5, the arrangement of a particular section enables the crown to be easily manipulated when this is removed over tube 2, as in FIG. 3 and described in the following paragraph, with a tool such as a traditional Allen key. The section of the tool allows the piston to be locked in rotation, whereas the lower end 52 of the coupling member 5 has a supporting surface for the tool so that a force F2 can be exerted against the force F1 exerted by the restoring means 4 in order to separate the cover 11 from the coupling member 5 and perform the adjustment of the orientation of the crown. Other sections for the opening 56 such as square or triangular sections, for example, are also possible to perform this manipulation depending on which tool is to be preferred.

The FIG. 3 shows a view similar to FIG. 1, i.e. a sagittal section, of a crown constituting the screwdown element 1 according to a preferred embodiment of the invention with a coupling member 5 consistent with that shown in FIG. 2B with a tooth arrangement 551 in an orthogonal plane to the rotational axis A-A of the crown. As the crown has been removed, the tube 2 is no longer visible in this figure and the gasket 6 is thus no longer compressed; all the other pieces are identical. In contrast to FIG. 1, the spring 8 of the piston 7 can extend since there is no longer any axial constraint either by means of the thread 51 for the position of the cover 11 or as a result of the indexed position of the winder stem, on which the piston 7 is intended to be mounted. However, it may be noted that it is not the compressed or extended position of the spring 8 of the piston 7 that determines which locking position P1 or position P2 for adjustment of the orientation the crown is in, since this position is defined solely by the position of the restoring means 4, which are associated rotationally with the indexing means 551, 91 of the crown according to the invention.

FIG. 3 shows the system in adjustment position P2 as the restoring means are compressed by the application of a force F2 in an opposed direction to force F1. The cover 11 and the coupling member 5 are movable axially in relation to one another and in reverse between the first position P1 of FIG. 1, in which the cover 11 is rotationally fixed in relation to the coupling member 5, and in the second position P2 of FIG. 3, in which the cover 11 is free to turn around the rotational axis A-A of said screwdown crown, since the tooth arrangements 551 of the collar 55 of the coupling element 5 and 91 respectively of the intermediate element 9 are no longer engaged with one another. According to a preferred embodiment the restoring means 4 and said indexing means, the tooth arrangements 551 and 91 here, are determined in such a manner that the passage from position P1 to position P2 requires that a force F2 is applied against the restoring means 4, the intensity of said force being at least three times higher than force F1 exerted by the restoring means 4 at rest, i.e. in the locking position P1, in such a manner that any accidental handling error is excluded. In the case where the force F1 exerted by the restoring means 4 associated with the indexing means according to the invention is in the order of 14 Newton, it would be possible, for example, to configure the depth of the tooth arrangements 551 and 91 as well as the plastic properties of the element used as restoring means 4 in such a manner that it is necessary to exert a force in the order of 50 Newton to adjust the orientation of the crown 1. In order to determine the desired value of the force F2, it is likewise possible to make use of the orientation parameter of the tooth arrangements along an oblique axis in relation to rotational axis of the crown A-A.

It could be noted that according to the preferred embodiment described in FIGS. 1 and 3, it is not possible for the user to perform the adjustment once the crown 1 has been assembled on the tube 2. In fact, the placement of the tooth arrangement 551 of the coupling element 5 towards the inside of the centrepart 3 and the application of the force F1 in the same direction, on the one hand, prevents any separation of the cover 11 in relation to the coupling member 5 when the user pulls the cover 11 to displace the crown axially out of the centrepart 3, since the axial displacement of the cover 11 in this direction then tends to press the tooth arrangement 91 towards that of the coupling member 5. On the other hand, pressing the cover 11 towards the centrepart 3 would likewise not enable the tooth arrangements 551-91 to be separated from one another: if the crown 1 is not in its proximal position in relation to the centrepart 3, i.e. the closest possible axial position to the centrepart 3, the restoring means 4 can be compressed in this case, but the force to be exerted to separate the tooth arrangements should be appreciably higher than that which will bring the cover 11 back into its proximal position in relation to the centrepart, as outlined above for determination of the forces used for axially indexing the positions of the winder stem. The cover would thus be firstly returned to its proximal position before the tooth arrangements 551-91 can be separated. Now in this position no further axial movement is possible towards the inside of the centrepart 3 except by screwing onto the tube 2, and consequently the restoring means 4 can no longer be compressed to enable the tooth arrangements 551-91 to be disengaged. In any case, any manipulation error is prevented and the orientation of the crown could only be changed when this is unscrewed from the tube 2 and a tool such as a Allen key, for example, is applied to the lower end 52 of the coupling member 52 to exert the force F2 necessary to separate the cover 11.

As an alternative, the tooth arrangement 551 of the coupling member 5 can be arranged in the opposite direction on its upper face 54 with the other tooth arrangement 91 directly on the inside surface of the cover 114 and the restoring means 4 under a collar 55 to exert a force F1 this time in an axial direction not towards the inside but towards the outside of the centrepart 3. Passage from position P1 to position P2 could thus be effected by pulling the cover 11 out of the centrepart 3 when the crown is in screwdown position on the tube 2 or when the end of the winder stem is in distal position in relation to the centrepart 2, i.e. as far removed as possible axially in relation to the centrepart 3. In fact, in the first case no axial movement of the coupling member 5 is possible in relation to the tube 2, and in the second case no axial movement of the coupling member 5 out of the centrepart 3 is possible because its lower end 52 has come into abutment against the abutment surfaces of the piston 521, whereas an axial movement of the cover 11 is still possible in both cases, and this allows the elastic element to be compressed and the tooth arrangements to be disengaged from one another. Other variants with oblique tooth arrangements sloping from left to right or from right to left, depending on the direction chosen for the force of the restoring means 4, are possible without departing from the framework of the invention as soon as the adjustment of the orientation of the crown can be controlled completely separately from the normal use of the crown as part of its interaction with the movement, e.g. for operations relating to classic adjustment of the time, the day of the month or winding up the barrel.

With respect to the restoring means 4, the embodiment described by means of the figures has the advantage of not requiring restricted space between the upper surface 54 of the coupling member 5 and the inside surface of the covering cap 114 in the central opening 115.

According to the embodiment of FIG. 3, when the crown is located in the adjustment state P2, the covering cap 112 of the cover 11 bearing the logo L can be easily displaced angularly into a desired position by proceeding in the following manner. The cover 11 is held in the non-integral position P2 of the coupling member 5 by applying a force F2 onto the lower end 52 of the coupling member to the outside of the centrepart 3 or towards the covering cap 112, if the crown is removed. It can then be oriented by causing it to rotate into a desired angular position, which will be reproducible because of the indexing tooth arrangements for a number of discrete positions equal to the number of teeth, which simultaneously gives an indication of the precision of the adjustment. Once the desired angular position has been reached, all that is required is for the pressure exerted by the tool onto the lower end of the coupling member 52 to be released and the tooth arrangement 551 thereof will then be returned to that of the intermediate element 91 so that the coupling member 5 is once again rotationally fixed to the cover 11 in the locked position P1.

It will be noted that the use of a separate cover on the coupling member 5 enables the manufacturer of crowns to have a stock of coupling elements 5 and to use these elements with covers 11 bearing different designs, or other elements such as precious stones or the like, or with non-cylindrical external shapes, e.g. square, oval or any other particular geometric shape.

While the claimed invention has been described principally in relation to the non-restrictive example of a crown, it will be understood that the screwdown element 1 could equally be, for example, a manual or automatic valve, as well as a push-button, a corrector or even an orientable back.

The invention claimed is:

1. An orientable screwdown crown, comprising:

a cover; and a device for adjusting the angular orientation of said cover in relation to a watch centrepart, wherein said device for adjusting the angular orientation comprises a coupling member and indexing means between said cover and said coupling member as well as restoring means, and wherein said cover and said coupling member are axially movable relative to one another between a first position, in which said cover is rotationally fixed in relation to said coupling member, and a second position, in which the cover is free to turn around the rotational axis of said orientable screwdown crown, and said restoring means tend to rotationally fix said cover and said coupling member in said first position, and said indexing means comprise a first tooth arrangement arranged on said coupling member.

2. The orientable screwdown crown according to claim 1, wherein said first tooth arrangement cooperates with a second tooth arrangement arranged on an intermediate element integral with the cover, and wherein said restoring means are arranged to press said tooth arrangements one against the other.

3. The orientable screwdown crown according to claim 2, wherein said restoring means exert an axial force along the rotational axis of said screwdown crown oriented towards the inside of said centrepart.

4. The orientable screwdown crown according to claim 3, wherein said tooth arrangements are arranged in a plane perpendicular to the rotational axis of said screwdown crown.

5. The orientable screwdown crown according to claim 4, wherein the coupling member comprises a collar and said first tooth arrangement is arranged on a lower face of said collar.

6. The orientable screwdown crown according to claim 5, wherein said cover is formed from a covering cap and a lateral skirt, which define a central opening to accommodate said coupling member, and said restoring means are an elastic element arranged between a lower surface of said covering cap and an upper surface of said coupling member.

7. The orientable screwdown crown according to claim 6, wherein said coupling member comprises an axial cavity to accommodate a piston as well as a lower end comprising abutments to restrict the course of said piston.

8. The orientable screwdown crown according to claim 7, wherein said coupling member comprises a hexagonal lower opening and said piston comprises a corresponding hexagonal lower end.

9. The orientable screwdown crown according to claim 3, wherein said screwdown crown is connected to a winder stem and said restoring means exert a force with an intensity greater than that required during manipulation of the winder stem.

10. The orientable screwdown crown according to claim 9, wherein the cover and the coupling member are axially movable in relation to one another between a first position, in which the cover is rotationally fixed in relation to the coupling member, and a second position, in which the cover is free to turn around the rotational axis of said screwdown crown, wherein said restoring means and said indexing means are determined in such a manner that the passage from position to position requires that a force is applied against the restoring means, the intensity of said force being at least three times higher than force exerted by the restoring means at rest.

* * * * *